US005964152A

United States Patent [19]

Kim

[11] Patent Number: 5,964,152

[45] Date of Patent: Oct. 12, 1999

[54] METHOD FOR PRINTING BOTH SIDES OF PAPER IN A PRINTER

[75] Inventor: Yong-su Kim, Yongin, Rep. of Korea

[73] Assignee: Samsung Electronics Co., Ltd., Kyungki-do, Rep. of Korea

[21] Appl. No.: 09/089,430

[22] Filed: Jun. 3, 1998

[30] Foreign Application Priority Data

Oct. 10, 1997 [KR] Rep. of Korea ..... 97-52118

[51] Int. Cl.[6] ..... B41F 5/04

[52] U.S. Cl. ..... 101/229

[58] Field of Search ..... 271/65; 101/229

[56] References Cited

U.S. PATENT DOCUMENTS 5,690,325 11/1997 Morimoto ..... 271/65

*Primary Examiner*—Edgar Burr
*Assistant Examiner*—Charles H. Nolan, Jr.
*Attorney, Agent, or Firm*—Sughrue, Mion, Zinn, Macpeak & Seas, PLLC

[57] ABSTRACT

A method for printing both sides of a paper in a printer includes the steps of (1) providing a paper supply portion for guiding the entry of paper into a printing unit, a paper output portion for guiding the paper from the printing unit to be output from the printer, and a reversing portion for reversing the orientation of the paper having passed through the printing unit to be resupplied to the inlet of the printing unit, (2) supplying a sheet of paper to the printing unit through the paper supply portion to print a front image on a front side of the paper, (3) guiding the paper on which the front image is printed to the reversing portion to reverse the orientation of the paper, (4) resupplying the reversed paper to the inlet of the printing unit, (5) printing a rear image on the other side of the paper resupplied to the printing unit, and (6) outputting the printed paper through the paper output portion.

3 Claims, 4 Drawing Sheets

METHOD FOR PRINTING BOTH SIDES OF PAPER IN A PRINTER

BACKGROUND OF THE INVENTION

1. Field of the Invention

The present invention relates to a method for printing both sides of a paper in a printer.

2. Description of the Related Art

In a conventional electrophotographic printer, such as a laser printer or a photocopying machine, a desired image is printed on one side of a paper in a printing unit, and then the printed paper is output externally therefrom. Thus, the output paper must be reversed and resupplied to the printer by a user in order to print images on both sides of the paper.

SUMMARY OF THE INVENTION

An object of the present invention is to provide a method for printing both sides of a paper without having to manually re-feed the paper.

A method for printing both sides of a paper according to the present invention includes the steps of: providing a paper supply portion for guiding the entry of paper to a printing unit, installed at an inlet of the printing unit for printing an image on the paper, a paper output portion for guiding the paper to be output from the body of the printer, connected to the outlet of the printing unit, and a reversing portion for reversing the orientation of the paper having passed through the printing unit to be resupplied to the inlet of the printing unit, branching away from the paper output portion; supplying a sheet of paper to the printing unit through the paper supply portion to print a front image on a front side of the paper; guiding the paper on which the front image is printed to the reversing portion to reverse the orientation of the paper; resupplying the reversed paper to the inlet of the printing unit; printing a rear image on a rear side of the paper resupplied to the printing unit; and outputting the printed paper through the paper output portion.

A printing method according to another aspect of the present invention includes the steps of: providing a paper supply portion for guiding the entry of paper to a printing unit, installed at an inlet of the printing unit for printing an image on the paper, a paper output portion for guiding the paper to be output from the body of the printer, connected to the outlet of the printing unit, and a reversing portion for reversing the orientation of the paper having passed through the printing unit to be resupplied to the inlet of the printing unit, branching away from the paper output portion; supplying a first paper to the printing unit through the paper supply portion to print a front image on a front side of the first paper; guiding the first paper on which the front image has been printed to the reversing portion to reverse the orientation of the first paper, and keeping the first paper in the reversing portion in a standby state; supplying a second paper to the printing unit through the paper supply portion to print a front image on a front side of the second paper; guiding the second paper on which the front image has been printed to the reversing portion to reverse the orientation of the second paper, and at the same time resupplying the first paper to the printing unit to print a rear image on a rear side of the first paper, and outputting the first paper through the paper output portion.

The above and other features of the invention including various and novel details of method steps will now be more particularly described with reference to the accompanying drawings and pointed out in the claims. It will be understood that the particular printing method embodying the invention is shown by way of illustration only and not as a limitation of the invention. The principles and features of this invention may be employed in varied and numerous embodiments without departing from the scope of the invention.

DESCRIPTION OF THE PREFERRED EMBODIMENTS

Figure 1:
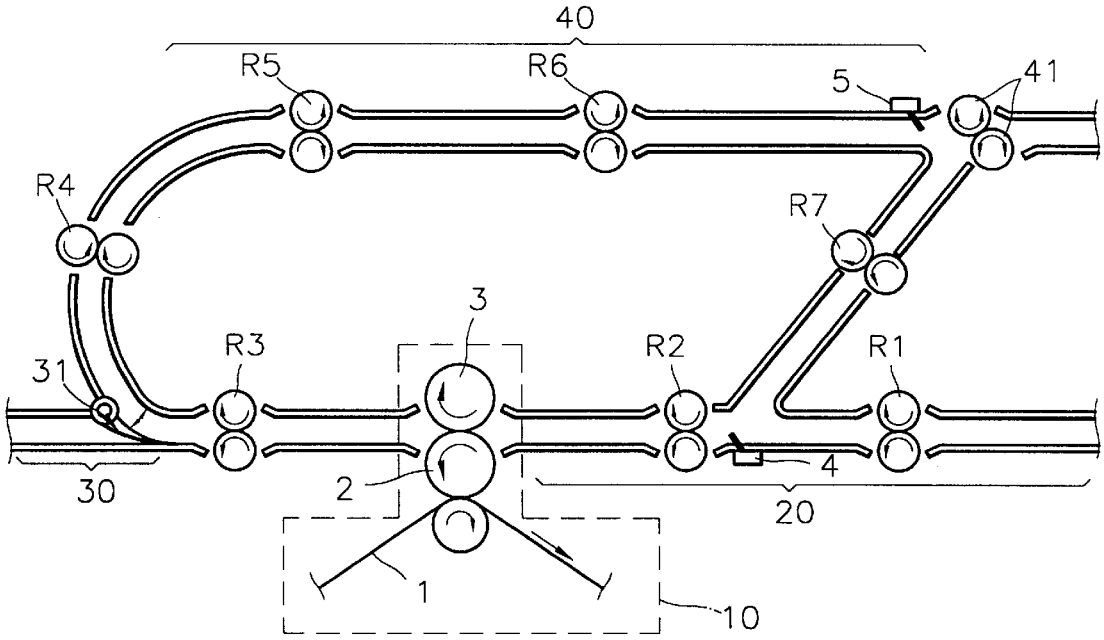
FIG. 1 is a schematic illustration of the internal structure of a printer for explaining a method for printing both sides of a sheet of paper according to the present invention.

Referring to FIG. 1, a printing unit 10 for printing a desired image on one side of a supplied paper is installed in the printer. The printing unit 10 includes a photosensitive belt 1, a transfer roller 2 and a fusing roller 3. An image provided on the photosensitive belt 1 is transferred to the transfer roller 2, and then printed onto one side of the paper as it passes between the transfer roller 2 and the fusing roller 3. A paper supply portion 20 for guiding the paper into the printing unit 10 and a paper output portion 30 for guiding the paper, once printed, out of the printer are installed at an inlet and an outlet, respectively, of the printing unit 10. A reversing portion 40, for reversing an orientation of the paper and resupplying the paper to the inlet of the printing unit 10, branches away from the paper output portion 30. A plurality of guide rollers R1 through R7, for transferring paper, are installed at the paper supply portion 20, the paper output portion 30 and the reversing portion 40. The reversing portion includes reversing rollers 41, for selectively rotating in a forward and a reverse direction, so that the paper is resupplied to the printing unit 10. A guide lever 31, for determining a proceeding direction of the paper, is pivotally installed at a point where the paper output portion 30 and the reversing portion 40 branch away from each other. A first and a second sensor 4, 5, respectively, are provided in the printer for detecting the location of the paper.

The method for printing both sides of paper according to the first embodiment of the present invention is described as follows.

Figure 2:
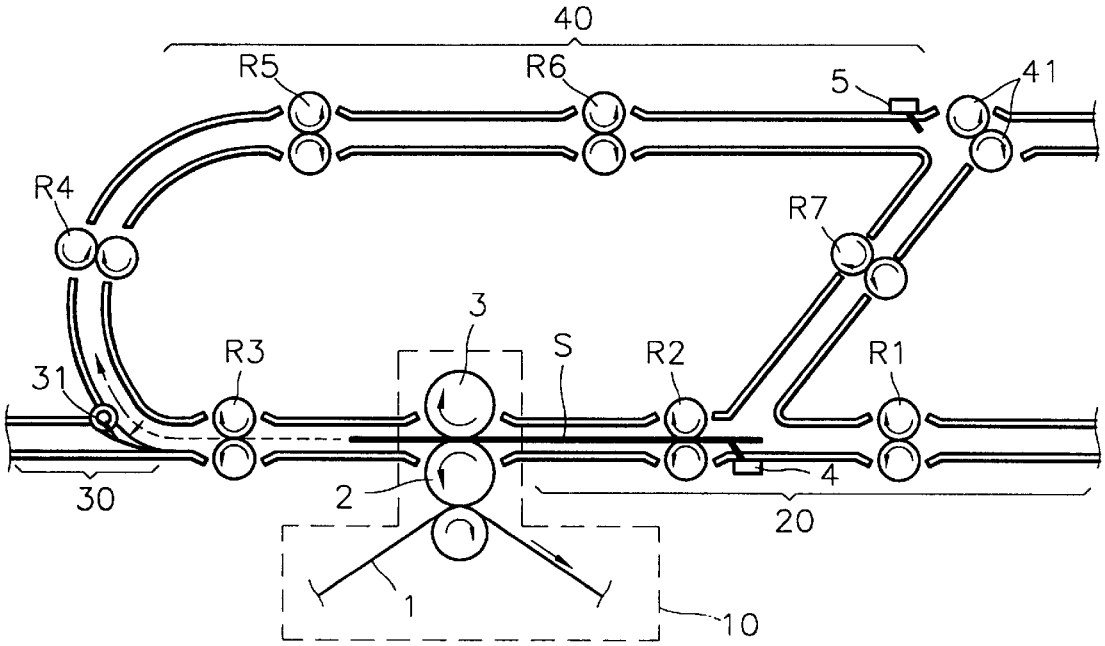
FIGS. 2 through 4 are schematic illustrations of the internal structure of a printer showing, in sequential order, the location of the paper according to a first embodiment of the present invention.
Figure 3:
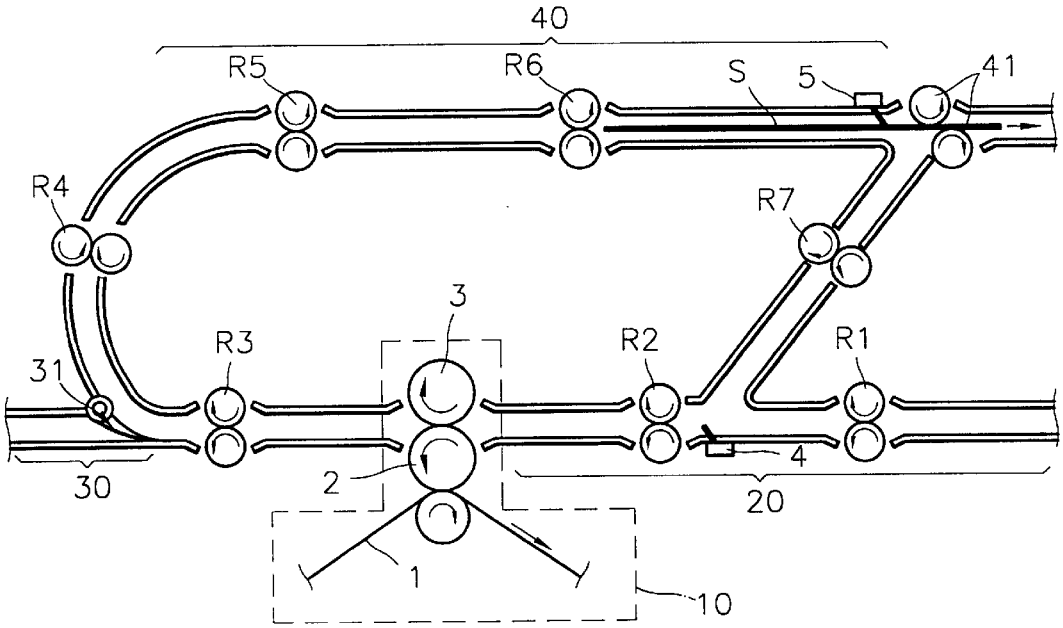
Figure 4:
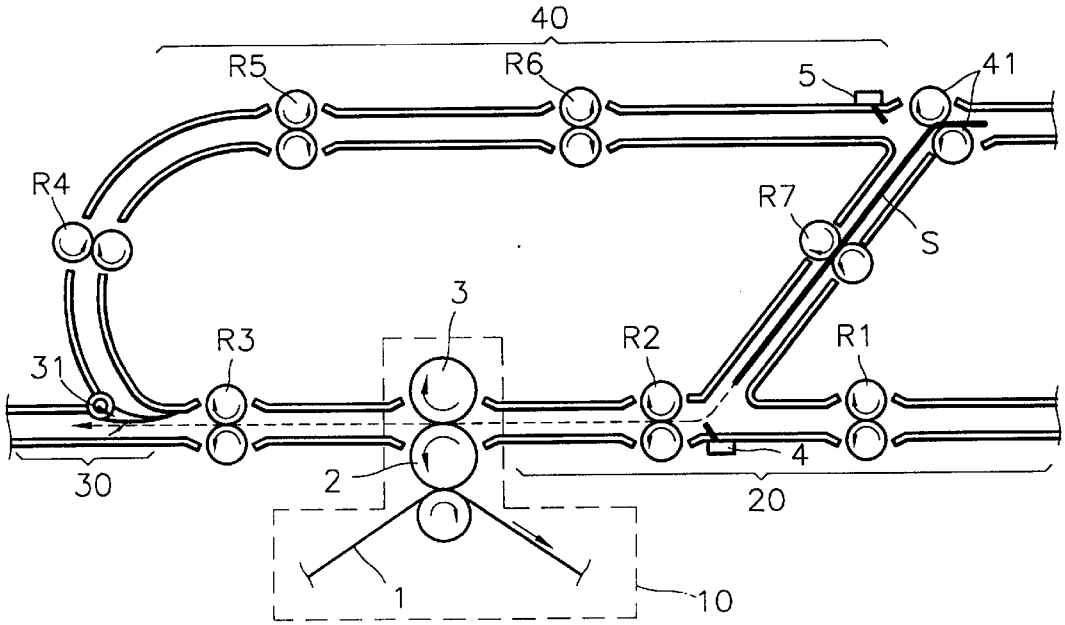

As shown in FIG. 2, paper 'S' enters the printing unit 10 from the paper supply portion 20. In the printing unit 10, a front image on the transfer roller 2 is printed on a front side of the paper 'S'. As shown in FIG. 3, the paper 'S' passes through the reversing portion 40 and is received by the reversing rollers 41. When the second sensor 5 detects the lagging edge of the paper 'S', the reversing rollers 41 rotate in a reverse direction to resupply the paper to the printing unit 10 as shown in FIG. 4. It is to be appreciated that the reversing portion 40 changes the orientation of the paper, such that, when the paper re-enters the printing unit 10, the previously printed front side of the paper faces the fusing roller 3, and a rear side of the paper 'S' faces the transfer roller 2. Thus, a rear image is printed on the rear side of the paper 'S'. The paper 'S', having the front and rear sides printed with the front and rear images, respectively, is output from the printer through the paper output portion 30. As described above, both sides of the paper are automatically printed inside the printer.

The method for printing both sides of a paper according to the first embodiment can be adapted to the printing of only one sheet of paper.

A method for printing both sides of a paper according to the second embodiment accomplishes printing on both sides of each of a plurality of papers.

Figure 5:
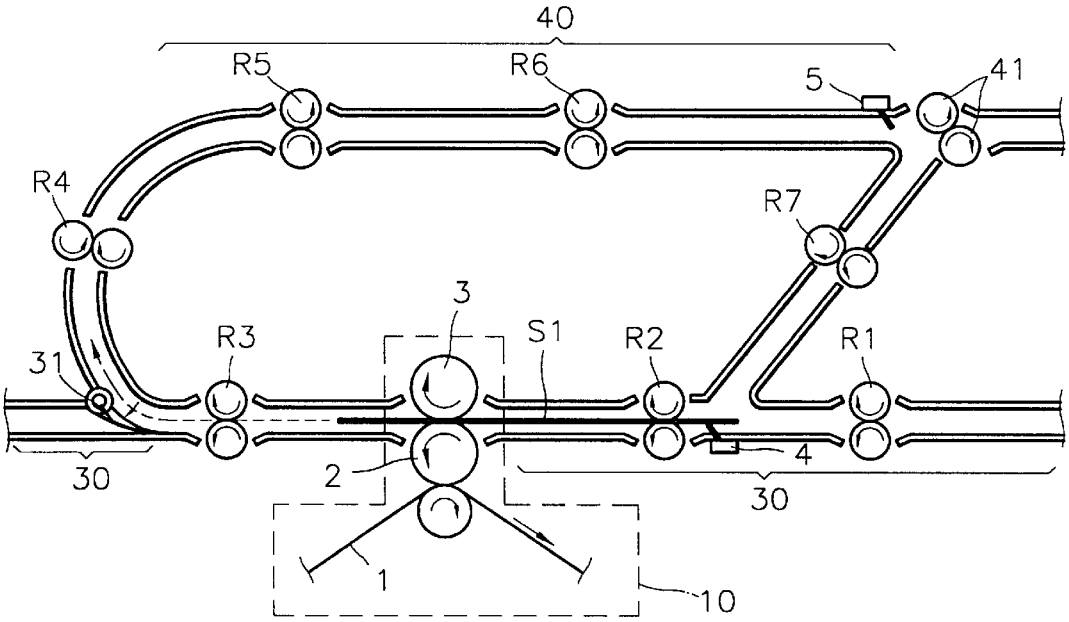
FIGS. 5 through 8 are schematic illustrations of the internal structure of a printer showing, in sequential order, the location of the paper according to a second embodiment of the present invention.
Figure 6:
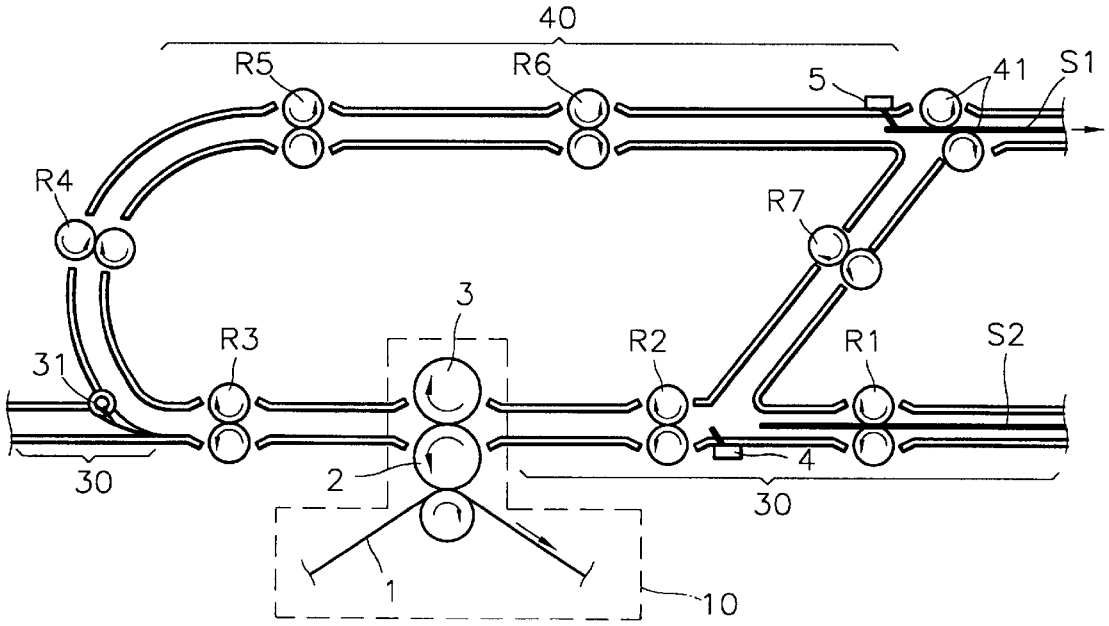
Figure 7:
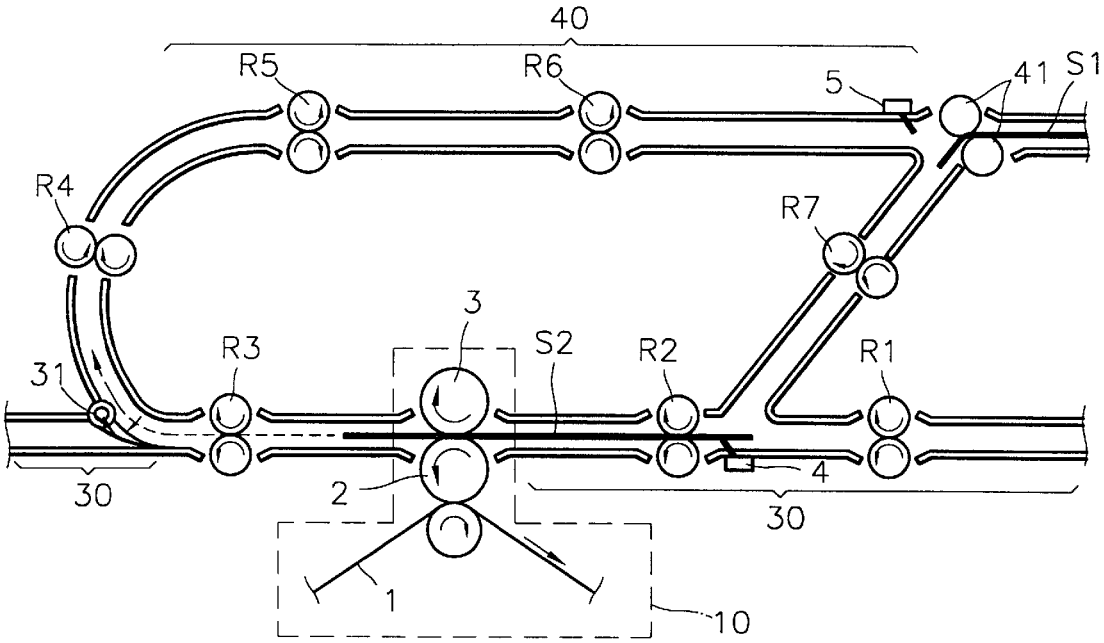
Figure 8:
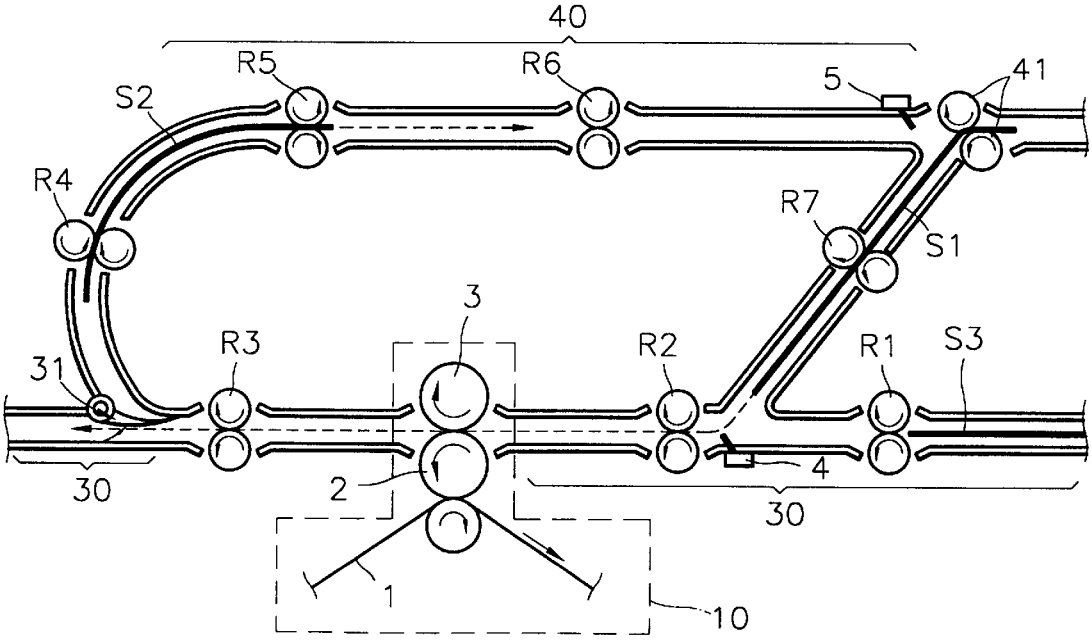

As shown in FIG. 5, a first paper 'S1' enters the printing unit 10 via the paper supply portion 20. The printing unit 10 prints a front image on one side of the first paper 'S1'. As shown in FIG. 6, the orientation of the first paper 'S1' is reversed as it passes through the reversing portion 40. The first paper 'S1' is then held between the reversing rollers 41 in a standby state. Meanwhile, a second paper 'S2' enters the printing unit 10 through the paper supply portion 20. The printing unit 10 prints a front image on one side of the second paper 'S2'. Similar to the first paper 'S1', the orientation of the second paper 'S2' is changed as it passes through the reversing portion 40. When the lagging edge of the second paper 'S2' is output from the printing unit 10, the reversing rollers 41 rotate in the reverse direction so that the first paper 'S1' is resupplied to the printing unit 10 as shown in FIG. 8. Accordingly, the other side of the first paper 'S1' is printed with a rear image and output through the paper output portion 30. While the other side of the first paper 'S1' is being printed, the second paper 'S2' is held between the reversing rollers 41 in a standby state. After a third paper 'S3' enters the printing unit 10 to have one side printed with a front image, and passes through the reversing unit 40, the second paper 'S2' is resupplied to the printing unit 10. The above-described printing process is repeatedly performed.

Preferably, modes, for the printing methods of the above-described first and second embodiments, are respectively set in the printer. For instance, in a first mode, the printer operates according to the first embodiment of the printing method to print on only one sheet of paper; and in a second mode, the printer operates according to the second embodiment of the printing method to print on a plurality of papers in sequence.

According to the method for printing both sides of a paper of a printer of the present invention, desired images can be printed on both sides of a paper by feeding the paper only once.

What is claimed is:

1. A method for printing on a front side and a rear side of a paper in a printer having a printing unit for printing an image on the paper as it passes through the printing unit, with an inlet portion and an outlet portion, the method comprising the steps of:

providing a paper supply portion to guide the paper to the inlet of the printing unit;

providing a paper output portion to guide the paper from the outlet portion of the printing unit to an exterior of the printer;

providing a non-moveable reversing portion to (1) reverse the orientation of the paper after it passes through the printing unit, and (2) resupply the paper to the inlet of the printing unit;

supplying a sheet of paper to the printing unit through the paper supply portion to print a front image on the front side of the paper;

guiding the paper on which the front image is printed through the reversing portion to reverse the orientation of the paper;

resupplying the paper to the inlet of the printing unit;

printing a rear image on the rear side of the paper resupplied to the printing unit; and outputting the paper through the paper output portion.

2. A method for printing on a front side and a rear side of a paper in a printer having a printing unit for printing an image on the paper as it passes through the printing unit, with an inlet portion and an outlet portion, the method comprising the steps of:

providing a paper supply portion to guide the paper to the inlet of the printing unit;

providing a paper output portion to guide the paper from the outlet portion of the printing unit to an exterior of the printer;

providing a non-moveable reversing portion to (1) reverse the orientation of the paper after it passes through the printing unit, and (2) resupply the paper to the inlet of the printing unit;

supplying a first paper to the printing unit through the paper supply portion to print a front image on the front side of the first paper;

guiding the first paper on which the front image is printed through the reversing portion to reverse the orientation of the first paper, and keeping the first paper in the reversing portion in a standby state;

supplying a second paper to the printing unit through the paper supply portion to print a front image on the front side of the second paper;

guiding the second paper on which the front image is printed through the reversing portion to reverse the orientation of the second paper, and at the same time resupplying the first paper to the printing unit to print a rear image on the rear side of the first paper; and outputting the first paper through the paper output portion.

3. A printer for printing on a front side and a rear side of a paper, said printer comprising:

a printing unit for printing an image on the paper as it passes through the printing unit, with an inlet portion and an outlet portion;

a paper supply portion to guide the paper to the inlet of the printing unit;

a paper output portion to guide the paper from the outlet portion of the printing unit to an exterior of the printer; and a non-moveable reversing portion to (1) reverse the orientation of the paper after it passes through the printing unit, and (2) resupply the paper to the inlet of the printing unit.

* * * * *